US006935972B2

(12) United States Patent
Hehr

(10) Patent No.: US 6,935,972 B2
(45) **Date of Patent: *Aug. 30, 2005**

(54) BREAKAWAY BASKETBALL RIM

(75) Inventor: Kenneth L. Hehr, Blaine, WA (US)

(73) Assignee: Porter Athletic Equipment Company, Broadview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/334,507

(22) Filed: Dec. 31, 2002

(65) Prior Publication Data

US 2003/0148834 A1 Aug. 7, 2003

Related U.S. Application Data

(63) Continuation-in-part of application No. 09/854,383, filed on May 11, 2001, now Pat. No. 6,503,160.

(51) Int. Cl.[7] ..... A63B 63/08
(52) U.S. Cl. ..... 473/486; 248/574
(58) Field of Search ..... 473/486, 485, 473/479, 488, 476, 478; 49/386; 267/153, 154; 248/548, 549, 573, 574, 583

(56) References Cited

U.S. PATENT DOCUMENTS

| | | | | |
|---|---|---|---|---|
| 3,462,143 A | | 8/1969 | Bidelman | |
| 4,111,420 A | | 9/1978 | Tyner | |
| 4,194,734 A | | 3/1980 | Tyner | |
| 4,365,802 A | | 12/1982 | Ehrat | |
| 4,433,839 A | | 2/1984 | Simonseth | |
| 4,483,534 A | * | 11/1984 | O'Donnell | 473/486 |
| 4,534,556 A | * | 8/1985 | Estlund et al. | 473/486 |
| 4,723,777 A | | 2/1988 | Jolly | |
| 4,738,448 A | | 4/1988 | Liester | |
| 5,305,997 A | | 4/1994 | Jolly | |
| 5,480,139 A | | 1/1996 | Owen, Jr. et al. | |
| 5,685,790 A | * | 11/1997 | Vaught | 473/486 |
| 6,080,071 A | | 6/2000 | Childers et al. | |
| 6,503,160 B2 | * | 1/2003 | Hehr | 473/486 |

* cited by examiner

*Primary Examiner*—Gregory Vidovich
*Assistant Examiner*—M. Chambers

(57) ABSTRACT

A breakaway basketball rim assembly in which the mounting bracket and rim are operably interconnected by a torsion rod which twists resiliently in response to an impact or other downward load on the rim. The torsion rod may extend parallel to the backboard, with one end being mounted to the mounting bracket and the other end being mounted to the rim, so that the torsion rod allows the rim to deflect downwardly about an axis that extends parallel to the backboard. The torsion rod may be mounted to overlapping flanges on the mounting bracket and the rim. There may also be a longitudinal torsion rod that extends perpendicular to the transverse torsion rod, so as to permit the rim to deflect downwardly about axes that extend both parallel and perpendicular to the backboard. Also provided is a structure for attaching the net to the rim member, in which there is a depending flange on the lower edge of the rim and a plurality of through openings having projections which receive and hold the attachment loops on the net.

7 Claims, 11 Drawing Sheets

BREAKAWAY BASKETBALL RIM

RELATED APPLICATION

This application is a continuation-in-part of U.S. patent application Ser. No. 09/854,383 titled "Breakaway Basketball Rim" filed on May 11, 2001 and issued into U.S. Pat. No. 6,503,160 on Jan. 7, 2003.

BACKGROUND OF THE INVENTION

1. Field of the Invention

The present invention relates to basketball rim assemblies, and, in particular, to such assemblies which are designed to flex or give way to relieve excessive loads that are applied to the rim without transmitting the loads to the backboard.

2. Related Art

"Breakaway" basketball rims are intended to prevent damage to the rim assembly and/or the backboard when a player applies excessive downward force to the rim. This commonly occurs when a player slams the rim during a "dunk" shot, or when a player grabs the rim and hangs from it. Unless the resulting downward loads are absorbed and dissipated by the rim assembly, either the circular rim (hoop) may bend or the backboard (which is commonly made of glass) may break or shatter; in that case, the rim and/or backboard must be replaced, which is both expensive and causes a significant time delay before play can be resumed.

A number of breakaway rims have been developed in the prior art, with varying degrees of success. One particular example is that shown in U.S. Pat. No. 6,080,071 (Childers et al.), in which there is a U-shaped channel that enables the rim to deflect downwardly in response to a downward load applied at any point along an arc at the front of the assembly. While successful in many respects, this device is comparatively complex and therefore expensive to manufacture. Also, like most of the prior art devices, the assembly includes various pivot points, springs, sliding surfaces and so on that are subject to wear and also require frequent adjustment and lubrication/maintenance. Moreover, because these components must be kept free of corrosion in order to function, most prior breakaway basketball rims are not suitable for use in outdoor installations.

Accordingly, there exists a need for a breakaway basketball rim assembly that is effective in absorbing downward loads that are applied to the rim, but which is also comparatively simple and inexpensive to manufacture. Furthermore, there exists a need for such a breakaway rim assembly that requires little or no adjustment or other maintenance. Still further, there exists a need for such a breakaway rim assembly that is durable and long lasting, and that is not adversely affected by corrosion or other damage when used in an outdoor installation.

Another need of a breakaway basketball rim assembly is to provide a precise field-adjustable method of calibrating the goal rigidity or energy absorption (ball rebound characteristics) when mounted on various support structures, to meet the requirements of organizations such as National Collegiate Athletic Association (NCAA). The goal should include an adjustment mechanism to increase or decrease the rigidity of the goal, when the goal is installed on a backboard and any type of support structure (e.g., a portable ceiling suspension, a wall mount, etc.).

One deficiency of traditional basketball rims, shared by breakaway and fixed rims alike, relates to the manner of attaching the net to the metal hoop of the assembly. As can be seen in FIG. 6, a typical prior art rim 01 includes a series of loops or hooks 02 that are mounted along its lower edge for attachment on the net (not shown). The hooks or loops may be formed individually or as part of a continuous wire 03, but in either case the wire must be bent to form the hooks/loops and must then be welded to the bottom edge of the steel hoop. In addition, a separate prop rod 04 or similar support is also often welded between the bottom of the hoop and the mounting bracket 05 to provide the assembly with sufficient strength and rigidity. These steps add significantly to the cost of manufacturing the rim assembly. Moreover, the "tacked on" wire hooks/loops are easily damaged and provide a foothold for corrosion in outdoor installations. Adding to these problems, the bent wire hooks/loops are not particularly easy to use when attaching a net to the assembly.

Accordingly, there exists a need for a structure for attaching a net to a basketball rim that does not require the fabrication and mounting of separate wire loops or hooks. Furthermore, there exists a need for such a structure that is easy to use, so as to facilitate rapid detachment of nets to the rim. Still further, there exists a need for such a structure that enhances the strength of the rim assembly without requiring a separate support or supports. Still further, there exists a need for such a structure that has a clean and smooth overall configuration, both to present a clean appearance and to minimize opportunities for corrosion to gain a foothold.

SUMMARY OF THE INVENTION

The present invention has solved the problems cited above, and is a breakaway basketball rim assembly in which the mechanism for allowing the rim to deflect downwardly and then returning it to a horizontal position comprises at least one torsion rod that twists resiliently under the load.

Broadly, the assembly comprises a base member, a rim member having a hoop portion for extending in a generally horizontal plane, and at least one torsion rod operably interconnecting with the rim member and the base member, the torsion rod having a first end which is mounted to the base member and a second end which is mounted to the rim member so as to be pivotable relative to the base member, so that in response to a downward impact on the hoop portion the torsion rod twists resiliently to permit the rim member to deflect downwardly relative to the base member.

The base member may comprise a mounting bracket for attachment to a generally vertical backboard. The one torsion rod may comprise a transverse torsion rod for extending generally parallel to the backboard when the assembly is mounted thereto, the transverse torsion rod having a first end which is suitably mounted to the mounting bracket and a second end which is mounted to the rim member, so that the torsion rod permits the rim member to deflect downwardly about an axis which extends generally parallel to the backboard.

The first end of the transverse torsion rod may be fixedly mounted to a forwardly projection flange portion of the mounting bracket and may pass through a cooperating bore in a rearwardly projecting flange portion of the rim member, and the second end of the rod may be fixedly mounted to a rearwardly projecting flange portion of the rim member and may pass through a cooperating bore in a forwardly projecting flange portion of the mounting bracket. Each end of the torsion rod may comprise a cylindrical exterior portion for pivotably engaging the bore through which the end of the rod passes, so that the first end of the transverse torsion rod supports the flange portion on the rim member in pivoting engagement therewith, and the second end of the torsion rod is supported by the flange portion on the mounting bracket in pivoting engagement therewith.

Also, the second end of the transverse torsion rod may be fixedly mounted to a lever arm member which co-operates with an adjustment mechanism to connect the second end of the torsion rod to a rearwardly projecting flange portion of the rim member. The adjustment mechanism includes a first portion fixedly secured to the lever arm member, a second portion fixedly secured to the rearwardly projecting flange portion of the rim member, and a set screw that extends through the second portion and engages the first portion to provide a set screw-type adjustment and apply varying or adjustable pressure against the lever arm member.

The rim assembly may comprise a longitudinal torsion rod for extending generally perpendicular to the backboard, the longitudinal torsion rod having a first end mounted to the mounting bracket and a second end mounted to the rim member, so that the longitudinal torsion rod permits the rim assembly to deflect downwardly about an axis extending generally perpendicular to the backboard. The transverse torsion rod may be mounted to the second, outer end of the longitudinal torsion rod. The mounting bracket may further comprise a support strut having an outer end in pivoting engagement with the longitudinal torsion rod, for supporting the longitudinal torsion rod against downward loads transmitted from the rim member.

The rim member may further comprise a depending flange portion mounted to the hoop portion and having a plurality of through openings with mounting structures for attachment of a basketball net thereto. The mounting structures may comprise first and second attachment members which extend upwardly from the bottom edge of the opening, the attachment members being spaced apart from one another and from first and second side edges of the opening so as to define the central gap and first and second receiving areas for receiving and holding an attachment loop of the net therein.

The attachment members may comprise first and second hook members that face outwardly in opposite directions so as to define the gap and receiving areas. The attachment members may also comprise first and second generally vertical post members which are spaced apart so as to define the central gap, and first and second generally horizontal post members which extend outwardly from the vertical post members so as to define the receiving areas.

In a first embodiment, the breakaway basketball rim assembly may comprise a support bracket for mounting to a generally vertical backboard, the support bracket having first and second parallel, forwardly extending flange portions; a rim member having a hoop portion for extending in a generally horizontal plane and first and second parallel, rearwardly extending flange portions; and a transverse torsion rod extending generally perpendicular to the flange portions in parallel to the backboard, the transverse torsion rod having first and second ends with cylindrical exteriors formed thereon, the first end of the torsion rod being fixedly mounted to a flange portion of the mounting bracket and passing through a cooperating bore in a flange portion of the rim member so that its cylindrical exterior is in pivotable engagement therewith, and the second end of the torsion rod being fixedly mounted to a flange portion of the rim member and passing through a cooperating bore in a flange portion of the mounting bracket so that its cylindrical exterior thereon is in pivotable engagement therewith, so that the pivotable engagement between the ends of the torsion rod and the flange portions supports the rim member and the mounting bracket for pivoting movement relative to one another, and so that in response to a downward impact on the rim member the torsion rod twists resiliently so as to permit the rim member to deflect downwardly relative the mounting bracket.

In another embodiment, the breakaway basketball rim assembly may comprise a mounting bracket for attachment to a generally vertical backboard; a rim member having a hoop portion for extending in a generally horizontal plane and further having first and second substantially parallel, rearwardly extending flange portions; a first, longitudinal torsion rod for extending generally perpendicular to the backboard, the longitudinal torsion rod having a first end fixedly mounted to the mounting bracket and a second end extending forwardly therefrom and having a cylindrical exterior surface formed thereon; a support strut having a first end mounted to the mounting bracket and a second end having a bore in which the cylindrical surface on the second end of the torsion rod is received in pivoting engagement, so that the strut supports the second end of the longitudinal torsion rod against downward loads transferred from the rim member; a transverse support tube mounted to the second end of the longitudinal torsion rod so as to extend at substantially right angles thereto, the support tube having a generally cylindrical internal bore; and a second, transverse torsion rod mounted in the support tube so as to extend generally parallel to the backboard, the transverse torsion rod having a first end which is fixedly mounted to a first end of the support tube and a second end which is fixedly mounted to the rim member; so that in response to a downward impact received on the hoop portion of the rim member the longitudinal and transverse torsion rods twist resiliently so as to permit the rim member to deflect downwardly about axes extending both parallel and perpendicular to the backboard.

These and other features and advantages of the present invention will be apparent from a reading of the following detailed description with reference to the accompanying drawings.

DETAILED DESCRIPTION

Figure 1:
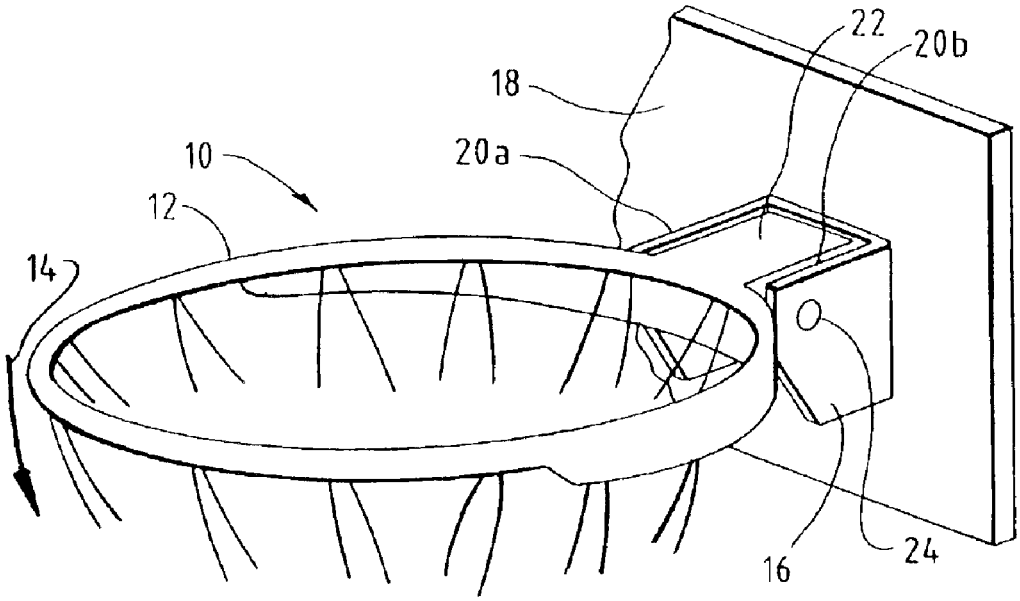
FIG. 1 is a perspective view of a breakaway basketball rim assembly in accordance with the present invention, showing the manner in which the rim deflects downwardly in response to a downward load received along the edge thereof.

FIG. 1 shows a breakaway basketball rim assembly 10 in accordance with the present invention. This embodiment is a single axis assembly, so that the rim 12 bends downwardly about a single axis in response to a downward force, as indicated by arrow 14.

As can be seen, the assembly includes a base bracket 16 that is mounted to the backboard 18 by bolts or other suitable means. The stationary bracket is U-shaped and has first and second forwardly projecting flanges 20*a*, 20*b* that extend on either side of a pivoting bracket 22 that is mounted and extended variably from the rim 12. The stationary and pivoting brackets 16, 22 are interconnected by a torsion rod pivot mechanism 24, as will be described in greater detail below. This arrangement of overlapping flanges/brackets provides a particularly strong and easily fabricated structure, however, it will be understood that any other suitable structure may be used to connect the ends of the torsion rod or rods to the rim and the stationary support in accordance with the present invention.

Figure 2:
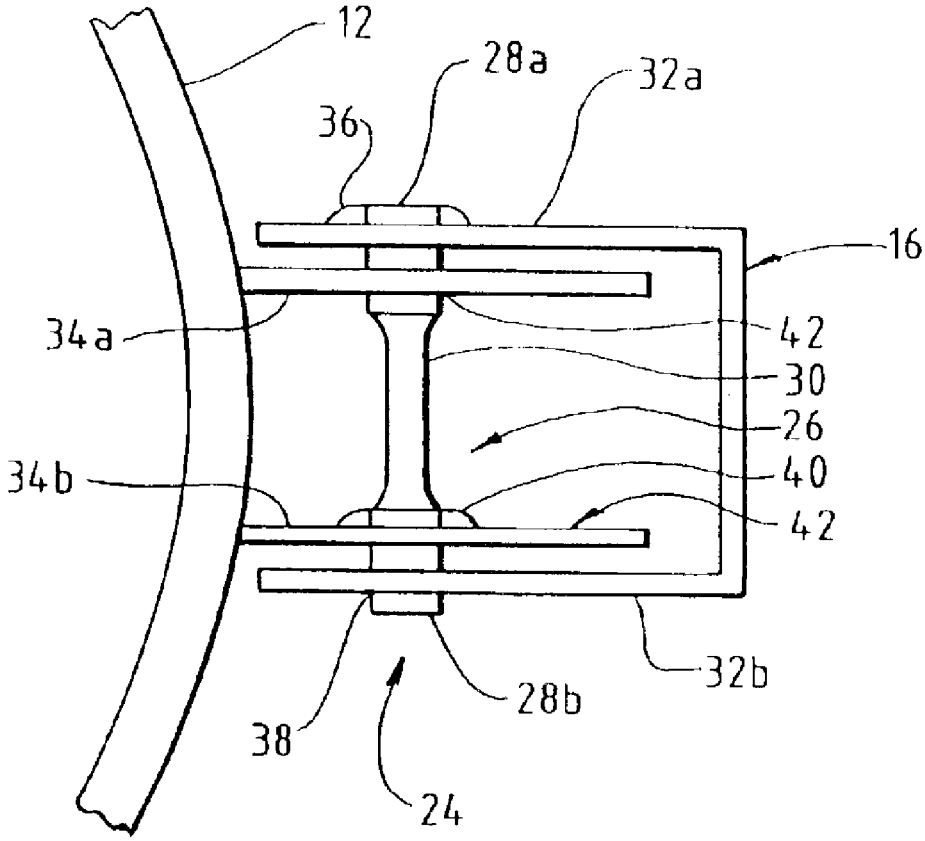
FIG. 2 is a top, plan view of the breakaway rim assembly of FIG. 1, partially cut away to show the torsion bar mechanism that supports the rim and permits it to deflect downwardly in response to downward loads.

The torsion bar pivot mechanism can be more clearly seen in FIG. 2. This includes a torsion rod 26 having first and second cylindrical end portions 28*a*, 28*b*, and a "necked down" cylindrical middle portion 30. The torsion rod is suitably formed of heat-treated steel, such as heat-treated 4130-alloy steel, for example. Furthermore, as used herein and in the appended claims, the term "torsion rod" includes all rods, bars, plates and similar members that deflect torsionally and resiliently in response to a twisting or turning force, whether having an elongate, cylindrical shape as shown in the drawings or some other configuration.

As can be seen, the cylindrical end portions 28*a*, 28*b* of the torsion rod are somewhat elongate and pass through bore in first and second flanges or plates on either side of the assembly. The outer plates 32*a*, 32*b* are formed by the forwardly projecting flanges of the stationary bracket 16, and the inner plates 34*a*, 34*b* are formed by the rearwardly projecting flanges of the pivoting bracket 22. The first end 28*a* of the torsion rod is fixedly mounted to the flange 32*a* of the stationary bracket by a weld 36 or other suitable means, while the opposite end of the torsion rod is free to rotate within a cooperating bore 38 in the opposite stationary flange 32*b*. This end of the rod, however, is fixedly attached to the inner flange 34*b* of the pivoting bracket, by a weld 40 or other suitable means, while the other end 28*a* of the rod is free to pivot within the cooperating bore 42 formed in the opposite rearward flange 34*a*.

Figure 3:
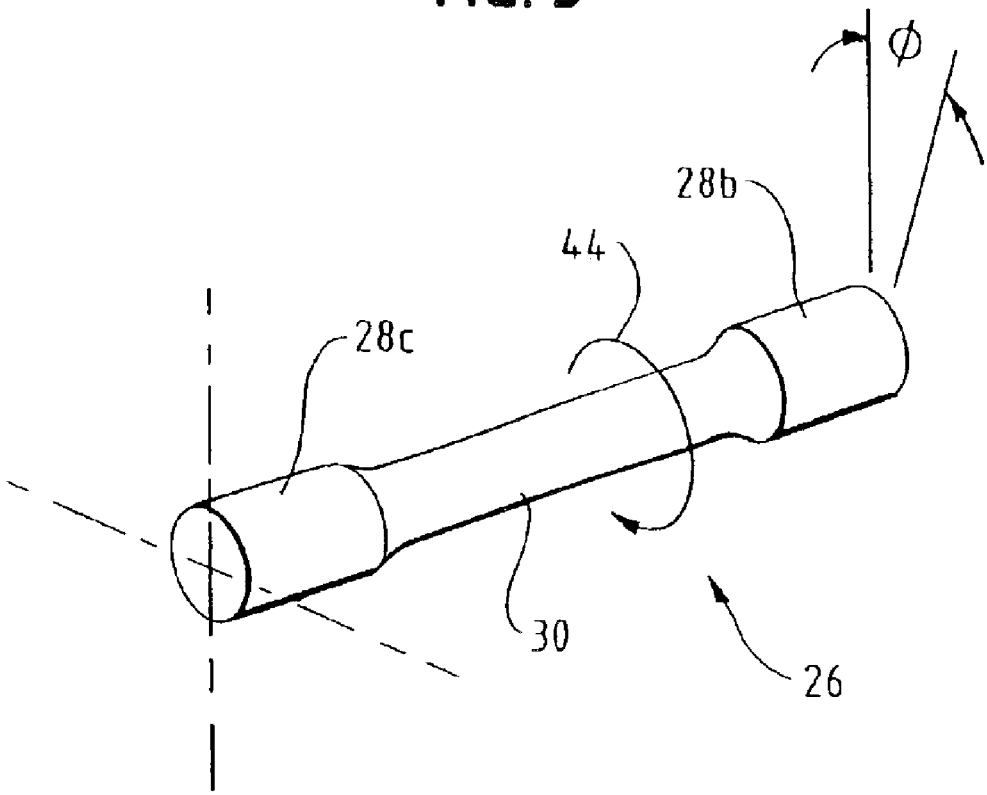
FIG. 3 is a perspective view of the torsion bar used in the breakaway rim assembly of FIGS. 1–2, showing the manner in which one end of the bar remains stationary while the other rotates with the rim, so that the middle section of the torsion rod twists resiliently to absorb the load.

Thus, as the rim 12 deflects downwardly as shown in FIG. 1, the second end 28*b* of the torsion rod pivots with the rim while its first end 28*a* remains stationary, so that the center portion 30 of the torsion rod is resiliently twisted by the load thereon. The torsional loading of the rod 26 is illustrated in FIG. 3. As can be seen, the angle $\Theta$ of rotation between the fixed and rotating rods is preferably confined to no more than about 15° (approximately 4½%) to avoid exceeding the yield stress of the rod, so that the rod returns resiliently to its initial orientation upon release. As was noted above, the suitable material for use in the rod is 4130 heat-treated alloy steel, which provides a suitable degree of resilience while still being able to be welded with comparative ease, although it will be understood that other suitable metallic and non-metallic materials will occur to those skilled in the art. The sizing of the rod itself will depend on anticipated loads and other factors; exemplary dimensions may be in the range from about 4–10" long and about ⅜–1" in diameter (in the middle portion 30), however it will be understood that a torsion rod or rods having any dimensions that yield suitable torsion characteristics may be used. In the embodiment which is illustrated, the middle portion 30 of the rod is configured to provide the desired torsional characteristics, while the ends 28*a*, 28*b* of the rod are somewhat larger in diameter: The enlarged ends form larger, longer-wearing bearing surfaces where these engage the cooperating bores in the plates, and also provide an enlarged area/circumference for welding at the fixed mounting points.

A breakaway rim assembly constructed in accordance with the embodiment described above has been found to absorb impact loads exerted by a 250-lb+ player, and exhibits excellent deflection and return characteristics. Moreover, as compared with the prior art devices described above, the assembly is comparatively simple and inexpensive to construct, and requires little or no maintenance. Moreover, the assembly is virtually unaffected by corrosion and is therefore suitable for outdoor installations; in the event that corrosion develops between the pivot points at the ends of the torsion rod during an extended period of non-use, this is immediately broken free with very little resistance the first time that the assembly is impacted or struck during play.

Figure 4:
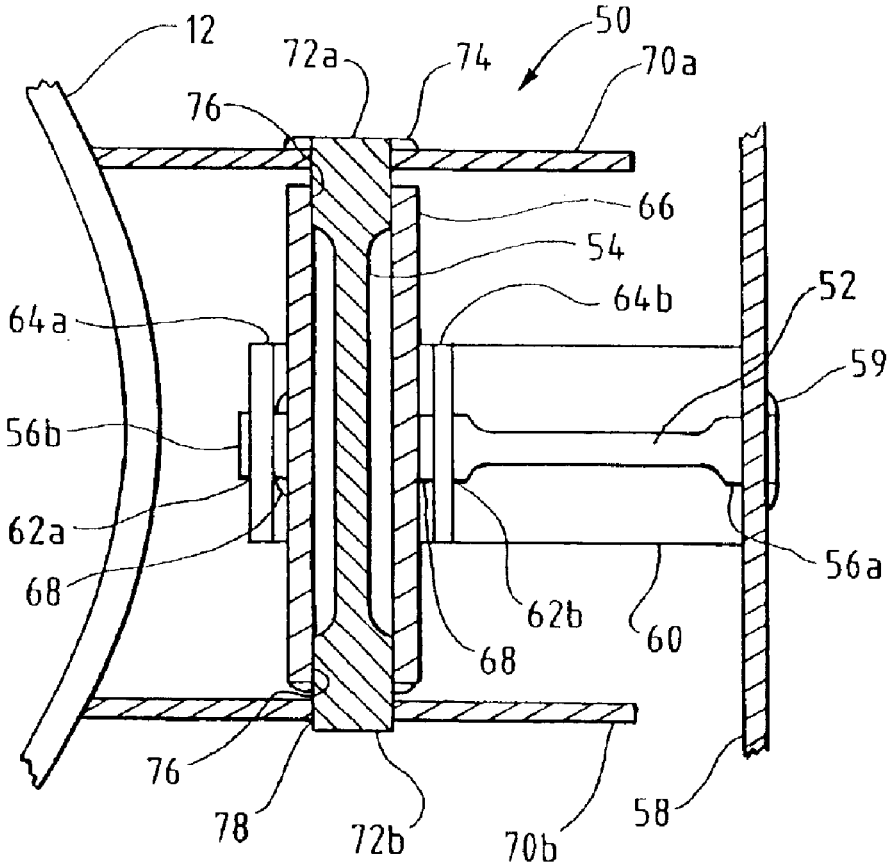
FIG. 4 is a top, plan view, similar to FIG. 2, showing the mechanism of a breakaway rim assembly in accordance with an embodiment of the present invention in which there are first and second torsion bars extending at right angles to permit the rim to bend downwardly about first and second axes.

FIG. 4 shows a pivot assembly 50 is accordance with another embodiment of the present invention, in which there are first and second torsion rods 52, 54 arranged at right angles so as to allow deflection along first and second axes. Each of the torsion rods 52, 54 is substantially similar to the torsion rod 26 described above in overall configuration, although it will be understood that these are preferably sized to provide suitable resistance when working in concert. The first, longitudinal torsion rod 52 extends perpendicular to the backboard, with its first end 56*a* being fixedly mounted to a stationary base plate 58, as by weld 59. A support strut 60 is also mounted to the stationary base plate and extends forwardly to the outer end of the longitudinal torsion rod. Bores 62*a*, 62*b* are formed in upwardly extending flanges 64*a*, 64*b* on the end of the strut for receiving and supporting the outer end 56*b* of the rod in pivoting engagement therewith, with the result that the strut 60 supports the outer end of the first torsion rod 52 against downward loads transmitted from the rim.

The outer end 56*b* of the first torsion rod 52, in the area between the supporting flanges 64*a*, 64*b*, is mounted (e.g., by welds 68) to the central portion of a transverse tube member 66, so that the tube member is able to pivot about the axis of the longitudinal rod by twisting the it in one direction or the other. The second torsion rod 54 resides inside the transverse tube, with its enlarged, cylindrical end portions 72*a*, 72*b* engaging the interior of the tube and projecting outwardly from the ends thereof. The ends of the tube members are flanked by first and second flange plates 70*a*, 70*b* that are mounted to the rim 12, and the projecting ends 72*a*, 72*b* of the transverse torsion rod pass through corresponding openings in the plates.

As can be seen in FIG. 4, the first end 72*a* of the transverse torsion rod is fixedly mounted to the first flange bracket 70*a* (by weld 74), but is in pivotable engagement with the bore 76 of the tube member. The opposite end 72*b* of the rod, in turn, is fixedly mounted to its end of the tube member (by weld 76), but is received rotatably in the bore 78 of the second flange plate 70*b*. Thus, in response to downward pressure received at the front of the rim, the fixed end 72*b* of the transverse torsion rod 54 remains stationary while the opposite end 72*a* rotates downwardly under the load. As this occurs, the first flange plate 70*a* pivots downwardly with the rotating end of the rod while the opposite flange plate 70 pivots on bore 78.

Figure 5:
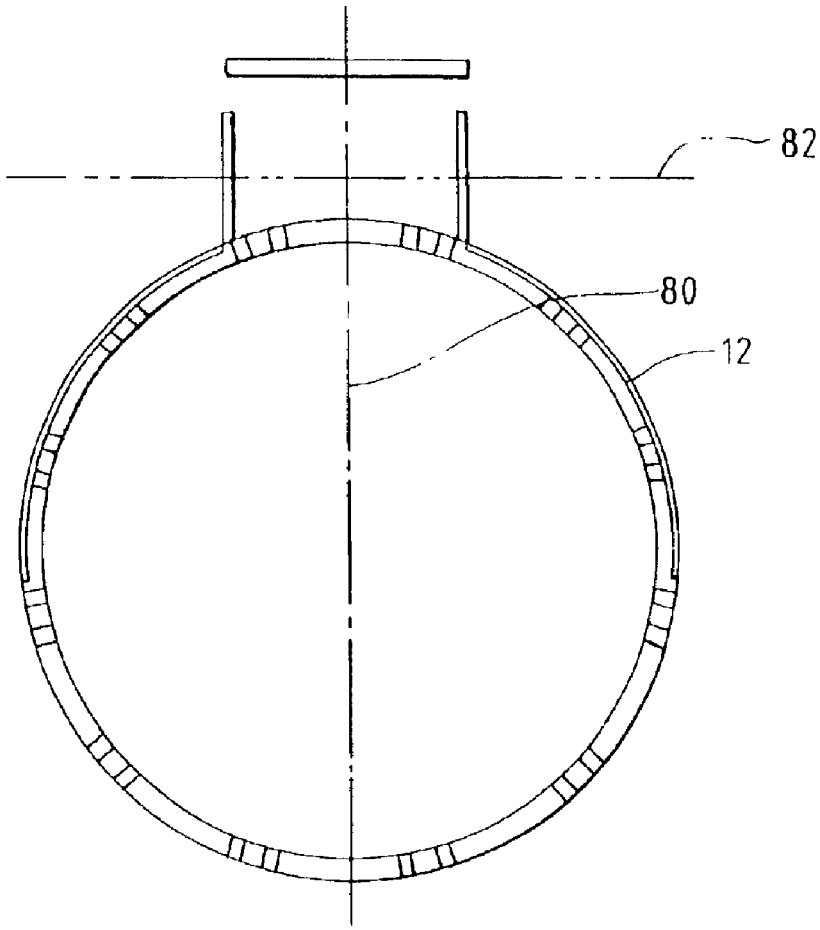
FIG. 5 is a top, plan view of a circular basketball rim as mounted to the two-axis torsion rod mechanism of FIG. 4, showing the first and second axes about which the rim is able to deflect in response to downward loads.

Consequently, as is shown in FIG. 5, the assembly 50 is able to deflect downwardly in response to downward loading of the rim 12, about a first axis 80 that is defined by the longitudinal torsion rod 52, and about a secondary axis 82 that is defined by the transverse torsion rod 54. The torsion rods are preferably sized proportionately so that the resistance (i.e., the amount of force needed to cause the rim to deflect) is roughly equal at any point along the rim, so as to provide a fairly uniform response to ball impacts and other loading.

It will be understood that, in addition to the right-angle arrangement described above, the torsion bars may be arranged at other angles, e.g., at various other angles to the backboard and/or to each other; for example, it may be found preferable for certain applications to have the axis or axes extend at angles other than parallel or perpendicular to the backboard. Furthermore, there may be additional (e.g., three or more) torsion rods in some embodiments, or there may be a rod that is bent or built-up into a configuration that permits torsional deflection to develop around more than one axis using a single unit. Still further, in some embodiments the ends of the rod or rods may have shapes or configurations other than the cylindrical shape of the examples described above; for example, the end of the rod (if it is not to be used as a pivoting bearing surface) may be angular or provided with other features for mounting it to the associated components of the assembly, or in some embodiments may have or be attached to a crank or another rod or an extension for transmitting/transferring the loads thereto.

Figure 6:
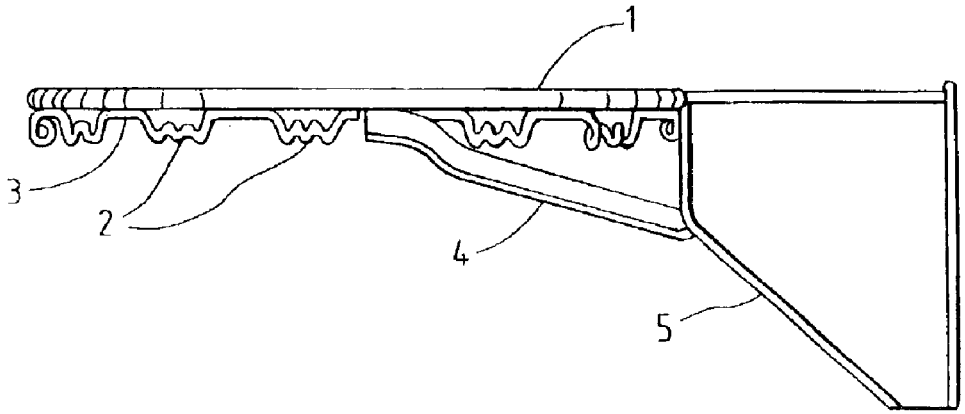
FIG. 6 PRIOR ART
FIG. 6 is a side, elevational view of a prior art basketball rim assembly, showing the conventional loops for attachment of the net thereto, the conventional loops being formed of bent wire and welded or otherwise mounted along the lower edge of the hoop.
Figure 7:
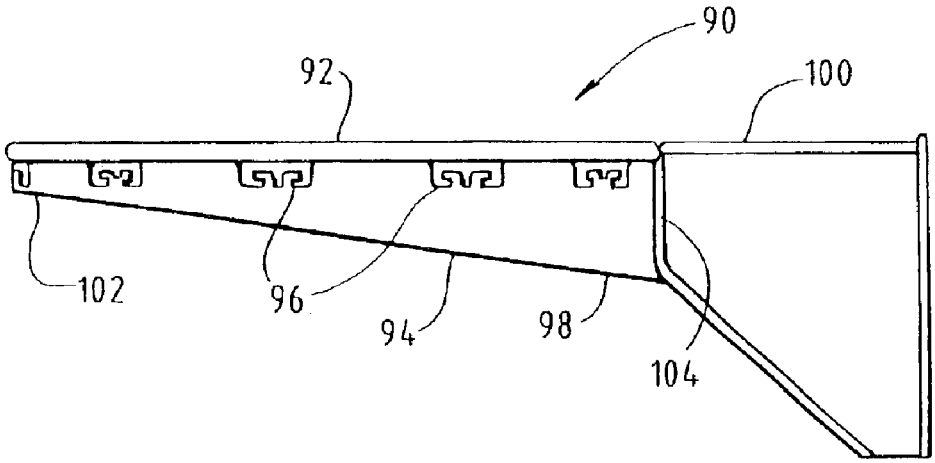
FIG. 7 is a side, elevational view, similar to FIG. 6, showing a rim assembly in accordance with an embodiment of the present invention in which the net attachment structure is formed by a series of openings in a depending flange that is mounted along the bottom of the hoop and also provides support for the hoop.

As noted above, the present invention also provides an improved structure for attachment of the net to the rim, which overcomes the deficiencies of conventional wire loops/hooks. Accordingly, FIG. 7 shows a basketball rim assembly 90 in accordance with the present invention, in which the hoop or rim 92 is provided with a depending flange 94 having a plurality of tie openings 96 formed therein. In the preferred embodiment that is illustrated, the depending flange is cylindrical and extends around the entire circumference of the rim, although it may extend only partway along the rim in some embodiments. Furthermore, the depending flange preferably tapers outwardly from the base of the assembly, so as to be comparatively deep in the area 98 adjacent the mounting bracket 100, and relatively shallow in the area 102 at the front of the rim; for example, the flange may suitably taper from about 2⅛ inches at the base to about ⅝ inch at the front lip. Consequently, the depending flange serves the added purpose of supporting the rim and providing a broad mounting area 104 for attachment to the bracket, thus obviating the need for a separate support strut or arm (see FIG. 6), while minimizing interference with the path of the ball at the front of the assembly.

The depending flange 94 is suitably formed of a steel plate, welded to the lower edge of rim 92; because the flange 94 is rigid and extends in substantially continuous contact with the lower edge of the rim (as compared with the bent wire arrangement described above), this not only reduces discontinuities that would otherwise encourage corrosion, but also imparts greater strength to the rim and renders the assembly easier to align and weld during fabrication.

The tie openings 96 are formed in the upper lip of the flange 94, so that their upper edges are defined by the rim 92 itself. This arrangement facilitates economical fabrication of the openings, which are suitably formed by laser cutting or similar techniques. In most embodiments there will be twelve of the openings, spaced more or less evenly about the perimeter of the rim, due to this being the number of tie loops on most regulation nets.

Figure 9A:
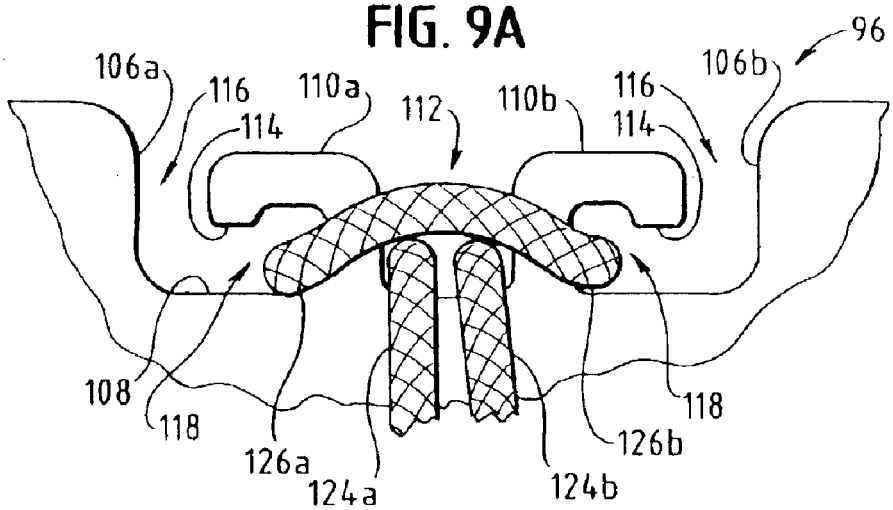
FIG. 9A is an enlarged, elevational view of one of the net attachment openings of the rim assembly of FIG. 7, showing the manner in which first and second opposite facing hooks are formed therein for attachment of one of the loops of the net thereto.
Figure 9B:
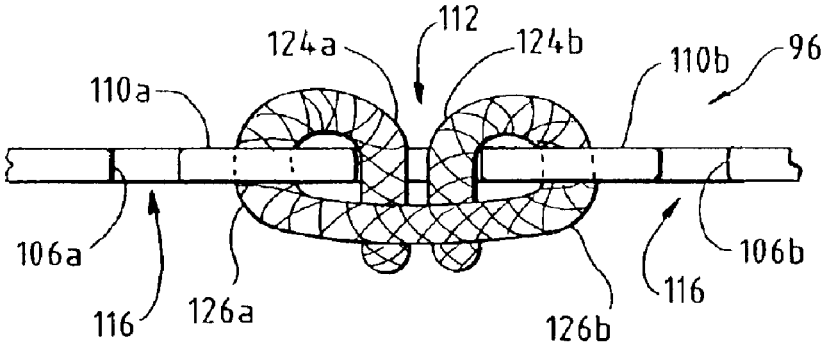
FIG. 9B is a top, plan view of the net attachment opening of FIG. 9A, showing the manner in which the cords of the net are routed through the attachment structure in greater detail.

FIGS. 9A–9B show the configuration of the tie openings 96 in greater detail. As can be seen, each of the openings includes a generally rectangular cutout having side edges 106*a*, 106*b* and a bottom edge 108. First and second, oppositely facing hook members 110*a*, 110*b* extend upwardly and outwardly on opposite sides of a central gap 112. The outer ends 114 of the hook members are separated from the sidewalls 106*a*, 106*b* of the opening by end gaps 116, and are down-turned so as to define first and second, semi-enclosed receiving areas 118.

Figure 8:
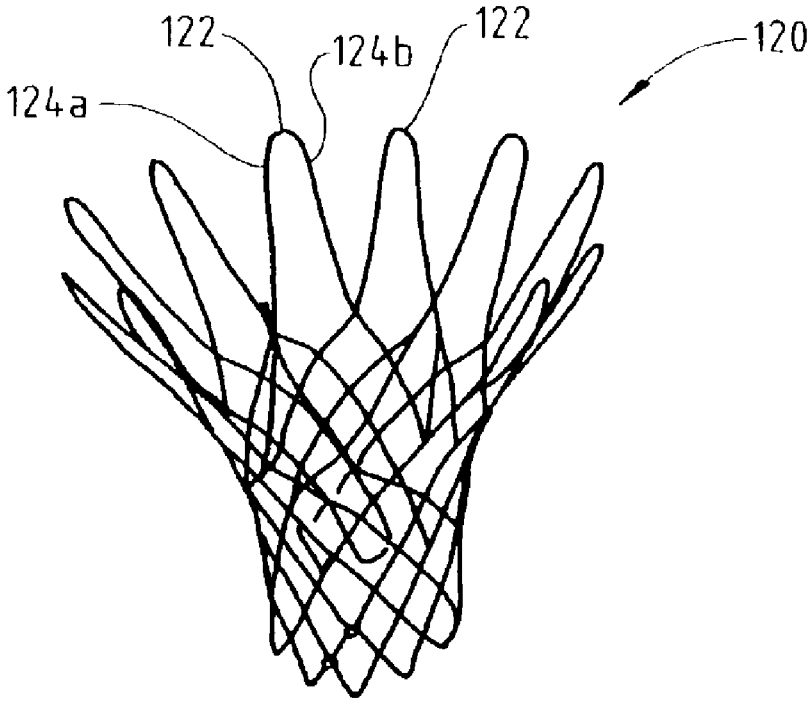
FIG. 8 is a perspective view of an exemplary, conventional basketball net, showing the arrangement of cords which form the loops for attaching the net to a rim assembly.

Attachment of the net is effected by routing the cords of the attachment loop through the hooks and openings in the manner shown. As can be seen in FIG. 8, a conventional basketball net 120 has a series of such loops 122 for attachment to the rim, each loop including first and seconds legs 124*a*, 124*b*. For attachment to the mounting structure of the present invention, each loop is inserted through an opening so that its two legs 124*a*, 124*b* lie in the gap between the hook members. The loop is then bent back upon itself and slipped over the ends of the hook members so that the legs of the loop enter the receiving areas 118, as indicated at 126*a*, 126*b*. In this manner, each loop is conveniently and securely attached to the rim assembly.

Suitable dimensions for an attachment structure in accordance with the embodiment of the invention shown in FIGS. 9A–9B are set forth in the following Table A:

TABLE A

| DESCRIPTION | SIZE (inches) |
|---|---|
| Overall height of attachment opening | ½" |
| Overall width of attachment opening | 1⅝" |
| Height of hook member | ⅜" |
| Width of central gap between hook members | ⅜" |
| Width of hook end gaps | 3/16" |
| Height of receiving area of the hook members | 3/16" |

Figure 10A:
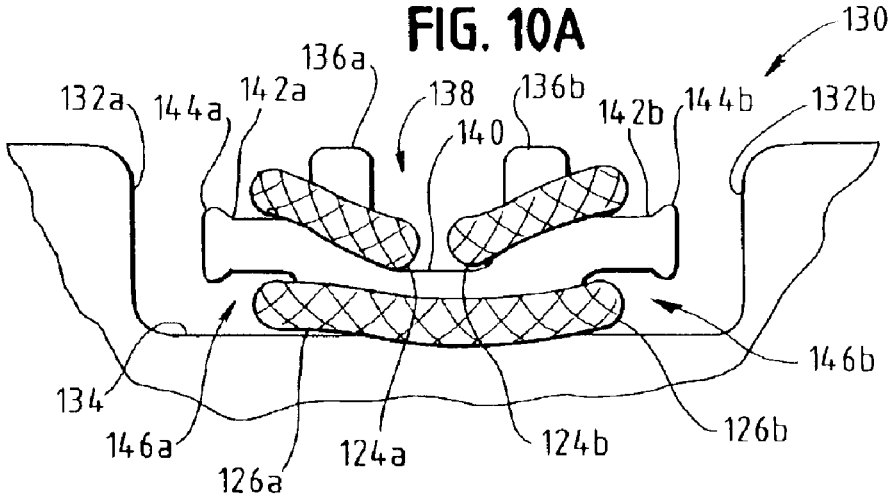
FIG. 10A is an enlarged, elevational view, similar to FIG. 8, showing a net attachment opening of a structure in accordance with another embodiment of the present invention, in which oppositely facing pegs are provided for attachment of the net rather than the first and second hooks that are shown in FIGS. 9A–9B.
Figure 10B:
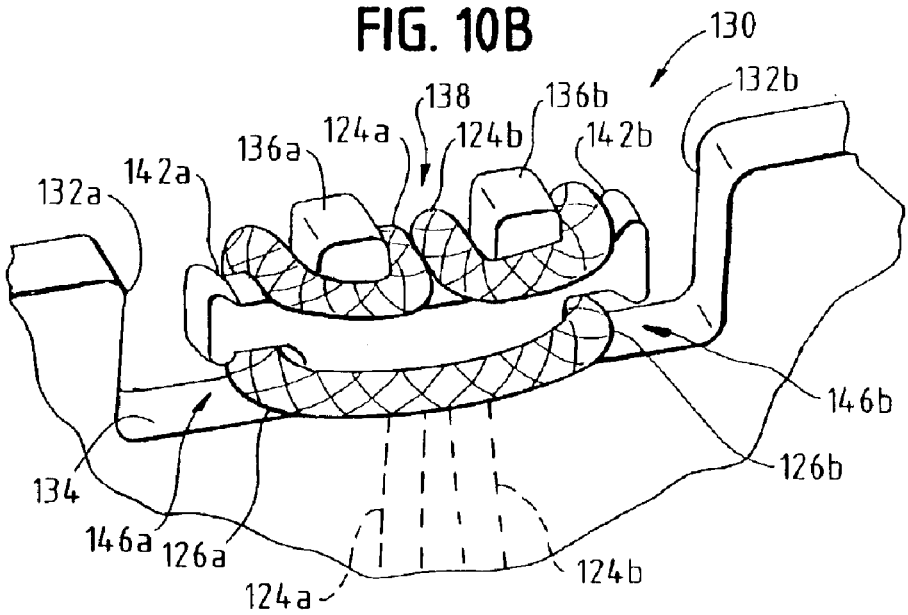
FIG. 10B is a perspective view of the net attachment opening of FIG. 10A, showing the manner in which the cords of the net are routed through the attachment structure in greater detail.

FIGS. 10A–10B shows a tie structure 130 in accordance with another embodiment of the present invention. This is somewhat similar to the structure shown in FIGS. 9A–9B, in that this has a generally rectangular opening with side edges 132*a*, 132*b* and a bottom edge 134. In this embodiment, however, the areas for receiving and engaging the cords of the net are defined by right-angle, outwardly facing post members, rather than the hook shaped members shown in FIGS. 9A–9B. Thus, as can be seen, there are first and second vertically extending post members 136*a*, 136*b* which again define a central gap 138 for receiving the legs 124*a*, 124*b* of the attachment loop, with the bottom edge 140 of the gap being raised somewhat above the level of the bottom edge 134 of the main opening.

First and second horizontal post members 142*a*, 142*b*, in turn, extend outwardly at right angles and in opposite directions from the vertical post members 136*a*, 136*b*. The outer ends 144*a*, 144*b* of the horizontal post members are flared somewhat to help prevent the cords of the attachment loop from sliding thereover, and are spaced inwardly from the edges 132*a*, 132*b* and 134 of the opening to define semi-enclosed areas 146*a*, 146*b* for receiving and holding the cords, as indicated at 126*a*, 126*b*. Attachment of the loop is accomplished by inserting this through the central gap and then bending it back over the outwardly extending posts 144*a*, 144*b*, in a manner similar to that described above. In the embodiment which is shown in FIGS. 10A–10B, however, and additional turn can be made about the vertical posts 136*a*, 136*b*, as indicated at 148*a*, 148*b*, making for an even more secure attachment.

Suitable dimensions for an attachment structure in accordance with the embodiment of the invention which is shown in FIGS. 10A and 10B are set forth in the following Table B:

TABLE B

| DESCRIPTION | SIZE (inches) |
|---|---|
| Overall height of attachment opening | ½" |
| Overall width of opening | 1⅝" |
| Width of central gap between posts | ⅜" |
| Height of floor of gap above bottom of opening | ⅛" |
| Total included width of first and second upright post members | 11/16" |
| Vertical width of horizontal post members | ⅛" |
| End gap between horizontal post members and sidewalls of opening | 3/16" |
| Height of receiving area at horizontal post members | 3/16" |

It will be understood that the above dimensions are provided for the purpose of illustrating examples of two preferred embodiments of the present invention, and that other structures in accordance with the present invention may have somewhat different dimensions, and may also differ somewhat in the configuration of the projections and other features from the examples which have been described herein.

Figure 11:
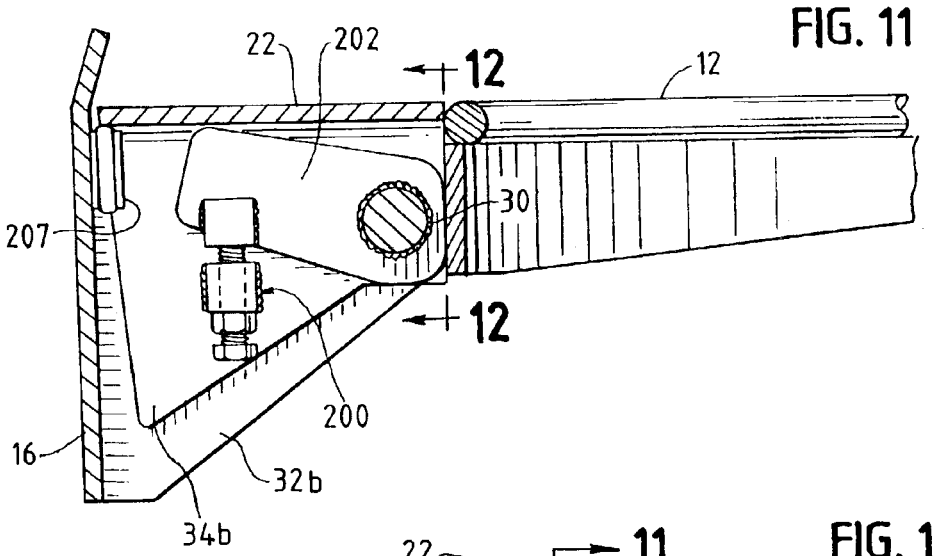
FIG. 11 is a sectional view, showing another embodiment of the torsion bar mechanism of the present invention with an adjustment mechanism for increasing or decreasing the torsion provided by the mechanism.
Figure 12:
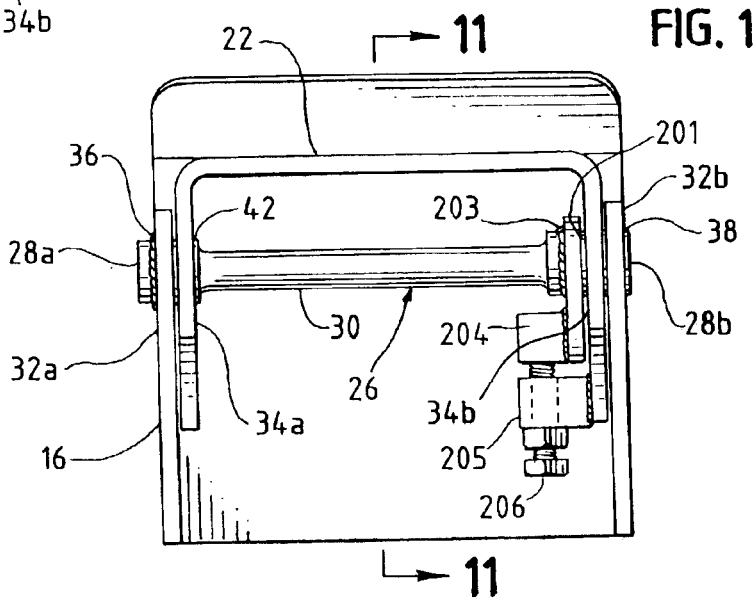
FIG. 12 is a sectional view taken along line 12—12 in FIG. 11.
Figure 13:
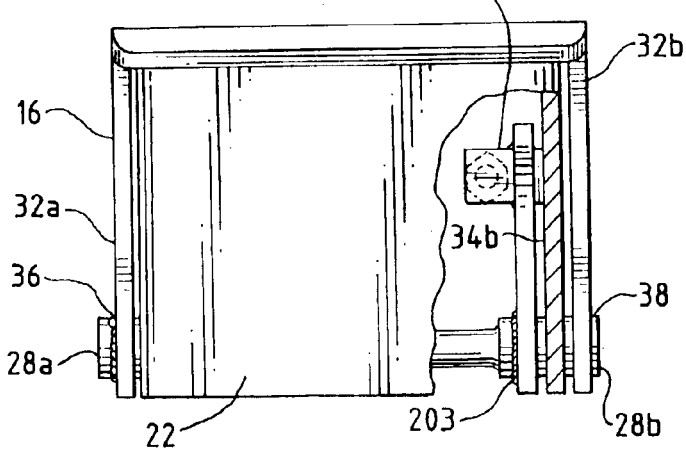
FIG. 13 is a plan view of the torsion mechanism shown in FIG. 11, with the pivoting bracket of the rim partially cut away to show the adjustment mechanism.

A further embodiment of the present invention includes the stationary and pivoting brackets 16 and 22, respectively, and an adjustment mechanism 200. (See FIGS. 11–13). As with the embodiment of FIG. 2, the first end 28*a* of the torsion rod 26 lies fixedly mounted to the outer plate 32*a* of the bracket 16; and it extends through an opening 42 in the inner plate 34*a* of the pivoting bracket 22. However, in this embodiment, the second end 28*b* of the extends through an opening 201 in the inner plate 34*b* of the pivoting bracket 22 and through the opening 38 in the stationary flange 32*b*. The torsion bar 26 freely rotates within openings 42, 201 and 38.

A lever arm member 202 lies fixedly secured by a weld 203 to the torsion bar 26 inwardly of the inner plate 34*b*. The adjustment mechanism 200 connects this lever arm member 202 to the inner plate 34*b* of the pivoting bracket 22. The adjustment mechanism 200 includes a first portion 204 fixedly secured (e.g., welded) to the lever arm member 202, a second portion 205 fixedly secured (e.g., welded) to the inner plate 34*b*, and a set screw 206 that extends through the second portion and engages an outer surface of the first portion to allow a set screw-type adjustment so that one may apply varying or adjustable pressure against the lever arm 202. In this way, the adjustment mechanism provides a micro-type adjustment of the torsion provided by the torsion bar of the present invention.

A stop 207 (shown in FIG. 11) includes a rigid body and a resilient O-ring. It lies fixedly secured to the stationary bracket 16 at the position shown; and it stops and holds the pivoting bracket 22 in the horizontal position of FIG. 11.

It is therefore to be recognized that various alterations, modifications, and/or additions may be introduced into the constructions and arrangements of parts described above without departing from the spirit or ambit of the present invention.

What is claimed is:

1. A breakaway basketball rim assembly, comprising:

a base member;

a rim member having a hoop portion for extending in a generally horizontal plane;

at least one one-piece torsion rod disposed transversely and operably interconnecting the rim member and the base member, the torsion rod having a first end mounted to the base member and a second end mounted to the rim member so as to be rotatable relative to the base member;

the torsion rod twisting resiliently in response to a downward impact on the hoop portion so as to permit the rim member to deflect downwardly relative to the base member; and an adjustment mechanism disposed between the torsion rod and the rim member, the adjustment mechanism providing adjustment of the torsion provided by the torsion rod.

2. The basketball rim assembly of claim 1, wherein the base member comprises a mounting bracket for attachment to a generally vertical backboard.

3. The basketball rim assembly of claim 2, wherein the at least one torsion rod comprises a transverse torsion rod for extending generally parallel to the backboard, the transverse torsion rod having a first end mounted to the mounting bracket and a second end mounted to the rim member, so that the torsion rod permits the rim member to deflect downwardly about an axis extending generally parallel to the backboard.

4. The basketball rim assembly of claim 3, wherein the first end of the transverse torsion rod is fixedly mounted to a forwardly projecting flange portion of the mounting bracket and passes through a cooperating bore in a rearwardly projecting flange portion of the rim member, and the second end of the transverse torsion rod is fixedly mounted to a rearwardly projecting flange portion of the rim member and passes through a cooperating bore in a forwardly projecting flange portion of the mounting bracket.

5. The basketball rim assembly of claim 4, wherein the adjustment mechanism includes a lever arm member fixedly secured to the torsion bar, a first portion fixedly secured to the lever arm member, a second portion fixedly secured to the rearwardly extending flange portion of the rim member; and a set screw mounted on the second portion for engagement with the first portion.

6. A breakaway basketball rim assembly, comprising:

a mounting bracket for attachment to a generally vertical backboard, the mounting bracket having first and second parallel, forwardly extending flange portions;

a rim member having a hoop portion for extending in a generally horizontal plane and first and second parallel, rearwardly extending flange portions; and a one-piece transverse torsion rod extending generally perpendicular to the flange portions and parallel to the backboard, the transverse torsion rod having first and second ends with cylindrical exteriors formed thereon, the first end of the torsion rod being fixedly mounted to a forwardly projecting flange portion of the mounting bracket and passing through a cooperating bore in a rearwardly projecting flange portion of the rim member so that the cylindrical exterior of the torsion rod is in pivotable engagement with the rearwardly projecting flange portion of the rim member, and the second end of the torsion rod being mounted to a rearwardly extending flange portion of the rim member and passing through a cooperating bore in a forwardly projecting flange portion of the mounting bracket so that the cylindrical exterior of the torsion bar is in pivotable engagement with the forwardly projecting flange portion of the mounting bracket;

an adjustment mechanism connecting the second end of the torsion rod to the rearwardly extending flange portion of the rim member, the adjustment mechanisms providing adjustment of the torsion provided by the torsion rod;

the pivotable engagement between the ends of the torsion rod and the bores in the flange portions supports the rim member and the mounting bracket for pivoting movement relative to one another so that in response to a downward impact on the hoop portion the torsion rod twists resiliently to permit the rim member to deflect downwardly relative to the mounting bracket.

7. The basketball rim assembly of claim 6, wherein the adjustment mechanism includes a lever arm member fixedly secured to the torsion bar, a first portion fixedly secured to the lever arm member, a second portion fixedly secured to the rearwardly extending flange portion of the rim member; and a set screw mounted on the second portion for engagement with the first portion.

* * * * *